United States Patent [19]

DeRosa

[11] Patent Number: 4,471,510

[45] Date of Patent: Sep. 18, 1984

[54] TWO PIECE INTERCHANGEABLE BUTTON

[76] Inventor: Alfred C. DeRosa, 526 Oak St., Syracuse, N.Y. 13203

[21] Appl. No.: 443,851

[22] Filed: Nov. 22, 1982

[51] Int. Cl.[3] ..... A44B 1/18

[52] U.S. Cl. ..... 24/90 R; 24/90 A; 24/90 TA; 24/119; 24/624

[58] Field of Search ..... 24/90 R, 90 A, 90 TA, 24/119, 49 A, 594, 596, 605, 610, 624, 639, 642

[56] References Cited

U.S. PATENT DOCUMENTS

| | | | |
|---|---|---|---|
| 136,882 | 3/1873 | Thurber . | |
| 305,620 | 9/1884 | Mayer | 24/90 A |
| 338,409 | 3/1886 | Heath . | |
| 346,649 | 8/1886 | Fox . | |
| 453,570 | 6/1891 | Williams . | |
| 453,974 | 6/1881 | Williams . | |
| 473,861 | 4/1892 | Williams . | |
| 1,176,619 | 3/1916 | Sykes . | |
| 1,180,104 | 4/1916 | Barnes | 24/90 A |
| 1,275,139 | 8/1918 | Doran . | |
| 1,298,016 | 3/1919 | Cushman . | |
| 1,325,003 | 12/1919 | Cushman . | |
| 1,348,629 | 8/1920 | Cushman . | |
| 1,412,097 | 4/1922 | Weimer | 24/624 |
| 1,511,101 | 10/1924 | Belsky | 24/90 TA |
| 1,618,719 | 2/1927 | Meyer | 24/90 TA |
| 2,122,208 | 6/1938 | Lyle . | |
| 2,214,030 | 9/1940 | Pereles | 24/90 A |
| 2,423,535 | 7/1947 | Welter . | |
| 2,436,323 | 2/1948 | Nygard . | |
| 2,713,187 | 7/1955 | Chaves . | |
| 3,132,394 | 5/1964 | Russell | 24/119 |
| 3,341,905 | 9/1967 | Gill . | |
| 3,390,435 | 2/1966 | Zimber . | |
| 3,720,982 | 3/1973 | Myers et al. . | |
| 4,305,183 | 12/1981 | Weisz | 24/90 A |

*Primary Examiner*—Victor N. Sakran
*Attorney, Agent, or Firm*—Bruns and Wall

[57] ABSTRACT

A two piece garment button having a base that is sewn to the garment and an interchangeable button head having a key that is slidably received in the base and locked therein to form an assembly capable of being passed through a buttonhole and thus closing the garment.

5 Claims, 7 Drawing Figures

TWO PIECE INTERCHANGEABLE BUTTON

BACKGROUND OF THE INVENTION

This invention relates generally to garment buttons and, in particular, to a two piece interchangeable fastening device that permits the facing of a button to be changed quickly and conveniently.

In many types of garment applications it is desirous to change the appearance of certain pieces of clothing, such as jackets and the like, to compliment changes in the wearer's ensemble. Replacing the garment buttons is one such method. Continual cutting away the old buttons and sewing on new ones is, however, not only an arduous and time-consuming task but also soon destroys the garment fabric in and about the button location due to the repeated passage of needle and thread through the fabric. It has therefore been a longtime goal in the garment industry to find a button arrangement that will not only provide a means for quickly changing the button facing but also preserve the garment fabric.

Some fastening devices, such as the button disclosed by Thurber in U.S. Pat. No. 136,882, contain a threaded shank that is passed through the fabric and engages a nut on the backside of the garment to anchor the button in place. This arrangement requires that a hole be fashioned in the fabric to permit passage of the shank. This, of course, necessitates further working of the cloth in order to cut and tuft the hole. Even with a tufted hole, the rigid shank produces excessive wear in the cloth. Beyond this, buttons of this type never "hang" properly on the garment and thus give a rather false appearance that detracts from, rather than enhancing, the garment's looks.

In U.S. Pat. No. 2,713,187 to Chaves, there is described a two piece button that includes a retainer that is sewn to the garment and a facing button that is press fitted into the retainer. The facing button contains a downwardly projecting stud that is passed vertically into a receiving hole carried in the retainer. The stud is held in the retainer by friction. Accordingly, the facing button can be easily dislodged by the simple act of buttoning or unbuttoning the garment. Similarly, the friction fit can be easily worn through usage and/or laundering of the garment.

A detachable stud button is further disclosed in U.S. Pat. No. 3,390,435 in which the button is attached to a stud and the base of the stud, in turn, passed through a buttonhole formed in the garment. The base of the stud is locked to an enlarged fastener that prevents the stud from being inadvertently removed from the hole. As in the case of the above noted Thurber button, a special hole must be formed in the garment, the stud can cause excessive wear of the fabric and the button does not provide the same appearance of a more conventional sewed-on button.

SUMMARY OF THE INVENTION

It is therefore an object of the present invention to improve interchangeable buttons used on garments.

A further object of the present invention is to provide a simple two piece interchangeable button that gives the appearance of a conventional single piece button which is sewed to a garment.

A still further object of the present invention is to provide a two piece interchangeable button having a base section that can be sewn to a garment and a detachable head that can be securely affixed to the base but yet easily removed to change the button facing and/or appearance.

Another object of this invention is to provide a two piece button assembly having a base and an interchangeable button head that are generally impervious to wear and which can remain with the garment during cleaning or the like.

These and other objects of the present invention are attained by means of a two piece interchangeable button assembly including a base section that is sewn to the garment and a detachable button head that can be replaced to change the appearance of the button. The button head is mated to the base by a laterally acting slide mechanism which acts to pull a flat receiving surface on the base tightly into registration against a complementary surface on the button head. A stop is arranged to interrupt the travel of the button head when the two button sections are brought into registration.

BRIEF DESCRIPTION OF THE DRAWINGS

For a better understanding of these and other objects of the present invention, reference is had to the following description of the invention which is to be read in conjunction with the accompanying drawings, wherein.

DESCRIPTION OF THE INVENTION

Figure 1:
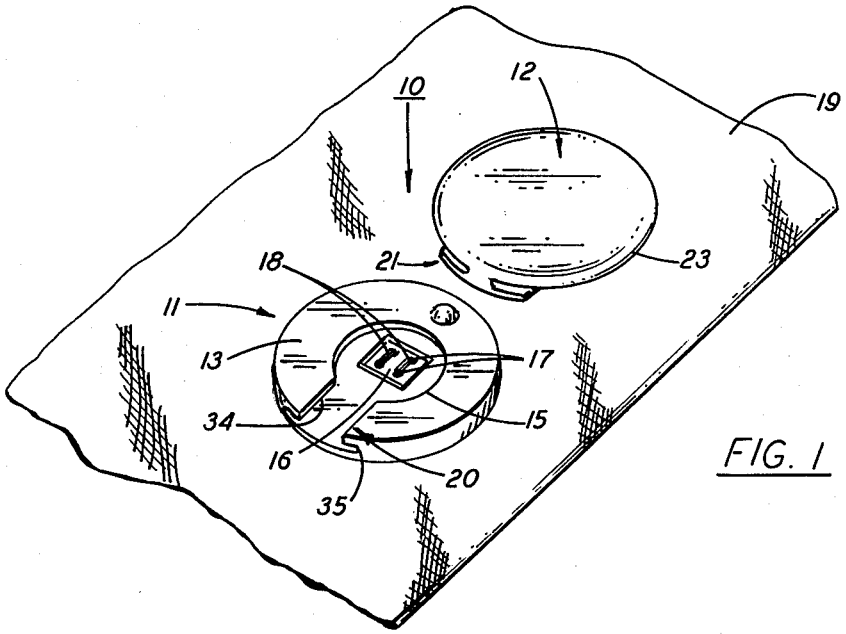
FIG. 1 is a perspective view of a two piece button embodying the teachings of the present invention with the button face removed in order to more clearly show the base section of the button in further detail.

FIG. 1 depicts a two piece button, generally referenced 10 having a base section 11 and a button head 12. In this particular view, the button head is shown removed from the base so that the interior of the base can be more clearly seen. The top surface 13 of the base contains an expanded central opening 15 that passes downwardly to a predetermined depth which terminates in a rectangular recess 16. The recess contains four thread receiving holes 17—17 that pass through the bottom of the base to provide a means by which the button can be attached as by thread 18 to the underlying fabric of a garment 19. As will be explained in greater detail below, the base also contains a T-shaped keyway, generally referenced 20, that is adapted to slidably receive a complementary key 21 depending from the bottom surface 23 of the button head 12.

The button head 12 forms an interchangeable part of the button assembly that allows the user a wide selection of different designs and/or textures that can be used to coordinate the garment to other pieces of wearing apparel. Although the head shown in the present embodiment is relatively plain, it should be clear that its appearance can be greatly varied without departing from the teachings of the present invention. For example, the head can be contoured to replicate a sewn on button of conventional design. Similarly, the head can be formed of metal, such as brass, and imprinted with a crest or insignia of the type commonly used with this type of button. The head can also be formed of different colored woods or plastics or for that matter covered with a desired fabric to provide a wide range of different colors and patterns.

Figure 2:
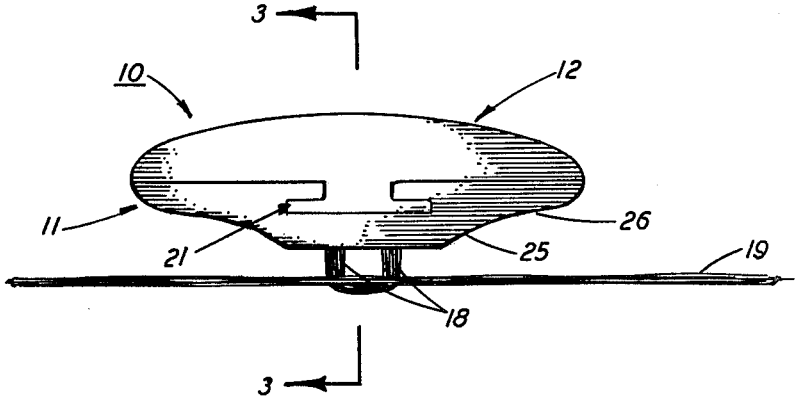
FIG. 2 is a side elevation of a button embodying the teachings of the present invention.
Figure 3:
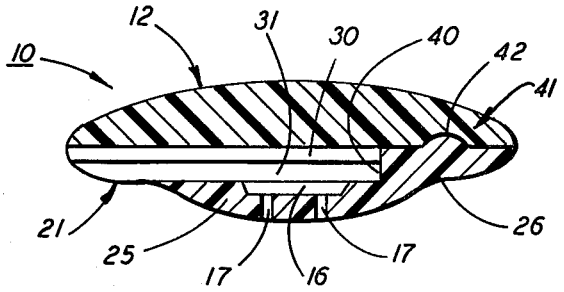
FIG. 3 is a sectional view taken along lines 3—3 in FIG. 2.

Turning now to FIGS. 2 and 3, there is shown one form of the present button that is similar to the button illustrated in FIG. 1 and wherein like parts are identified with like numbers. The base section 11 of the button is shown for the purposes of clarity a bit thicker than it would be in actual practice. Typically, the base provides a relatively thin profile that is barely discernible when the button head is locked in place in assembly. To this end it is preferred that the thickness of the head be about three times greater than that of the base. It is further preferred, as shown in FIGS. 2 and 3, that the shape of the base be generally convex to furnish a slightly protruding dome 25 centrally located on the bottom surface 26 thereof which surrounds the region where the threads 18—18 enter the base. This not only adds strength to the base but also enables the assembly to seat against the fabric in a manner that is exactly the same as a more conventional sewn on button.

As best seen in FIG. 3, the bottom surface 27 of the button head is also a flat or planar surface that complements the flat top surface 13 (FIG. 1) of the base so that, in assembly, the outer periphery of the head blends into that of the base to give the button a one piece appearance. The bottom surface of the head carries a dependent T-shaped key 21 that is snuggly received in the keyway 20 provided in the base. The key includes a narrow stem 30 to which is attached a horizontally disposed locking lug 31. The outside face 32 of the key is contoured to complement the profile of the base section to again aid in giving the button a one piece appearance in assembly.

The stem of the key is arranged to pass snuggly into the vertical opening 34 (FIG. 1) of the keyway while the locking lug of the key similarly passes into the expanded slot 35 of the keyway which generally parallels the flat top surface of the base section. To mount the button head upon the base, the locking key is passed into the keyway and moved therealong thus guiding the head laterally over the base. The locking key and the keyway are formed so that when the key is moved into the keyway, the bottom surface of the button head slides in slight running contact with the adjacent top surface of the base to provide a close fit between the two sections. Sufficient sliding contact is maintained between the coacting surfaces to insure that the two sections will remain locked together in assembly.

The base section of the assembly and the locking key of the button head are both formed of a resilient material, such as wood, plastic or metal. A slight interference fit can also be provided between the key and the keyway to further insure that the two cojoined sections remain locked together by friction when assembled. The keyway may also be slightly inclined in regard to the top surface 13 of the base so that the bottom surface 23 of the button head is drawn tightly against the base as the two button sections are moved laterally into registration again further securing the assembly. It should be noted that the depth of the thread receiving recess 16 is below the bottom surface of the keyway and the key is allowed to pass over the thread without interference therewith.

The keyway terminates in a vertical wall 40 that is arranged to intercept the interior end face of the key and thus prevent further movement thereof, when the button head is in registration with the base. The wall 40 thus serves as a stop for limiting the lateral movement of the head and thus insuring that the two cojoined members are properly aligned in assembly. A detent mechanism 41 is also provided for indexing the base and the button head. To this end, a spherical raised protrusion 42 is formed in the top surface 13 of the base which is adapted to seat in a complementary indentation formed in the adjacent bottom surface of the head when the two button sections are brought into registration. The use of resilient materials in the key and keyway allows the spherical protrusion to slide easily into and out of the indexing indentation without the use of undue force.

Figure 5:
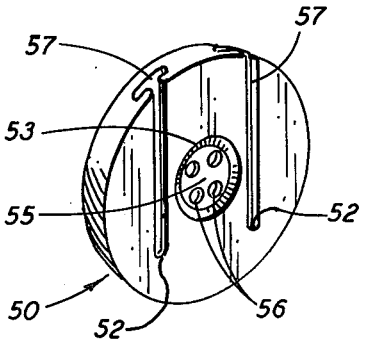
FIGS. 4 and 5 are perspective views illustrating another embodiment of a button assembly encompassing the teachings of the present invention, and FIGS. 6 and 7 further perspective views of a still further embodiment of a button assembly encompassing the teachings of the present invention.
Figure 4:
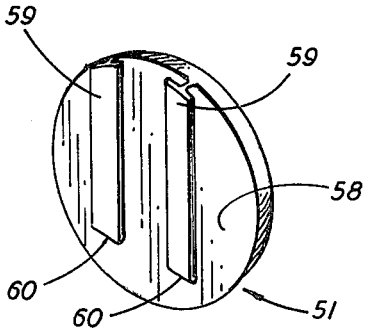

Turning now to FIGS. 4 and 5, there is shown another embodiment of the present invention wherein both sections of the button are formed of a resilient plastic. Here again, the button assembly consists of two pieces, a base section 50 and a button head 51. The base section includes a centrally located opening 53 that passes downwardly from the top surface 54 of the base and enters into a recess 55 containing thread receiving holes 56—56. A pair of parallel T-shaped keyways 57—57 are passed into the side wall of the base section and terminate in vertically aligned stop walls 52—52.

The head 51 of the button contains a flat bottom surface 58 that is placed in tight sliding registration with the top surface of the base section when the two sections are assembled. A pair of T-shaped locking keys 59—59, depend from the bottom surface of the button head and are arranged to be slidably received within the above noted keyways 57—57. As described above, the keys fit snuggly in the keyways and, through the use of resilient materials, serve to help lock the two button sections together in assembly. The rear end faces 60—60 of the keys come into abutting contact with stop walls 52—52 contained in the keyway to register the button head with the base section in the manner hereinabove noted. Although not shown, it should be understood that a detent mechanism can also be furnished to index the parts in assembly.

Figure 7:
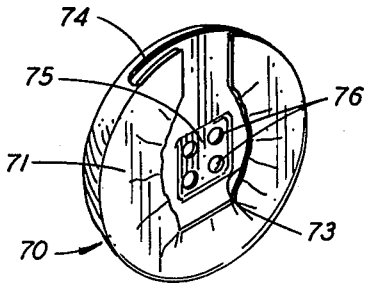
Figure 6:
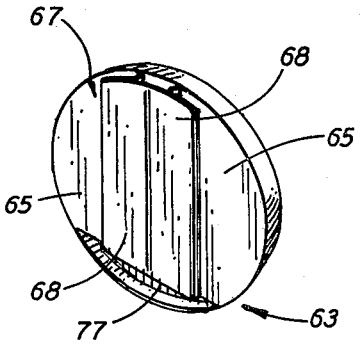

FIGS. 6 and 7 depict a button assembly embodying the teachings of the present invention wherein both sections of the button are fabricated from single sheets of a thin gauge resilient metal. The button head 63 is initially punched into a circular cup 64 that has two extended side skirts 65—65. The skirts are turned into the cup to form the flat bottom surface of the head. The remaining portion of the two skirts are rolled over upon themselves to form a T-shaped key generally referenced 67. It should be noted that the two horizontally extended lugs 68—68 making up the key are each fabricated doubling over the ends of the resilient sheets upon themselves. A slight space is provided between the doubled over sheets thus giving the key a spring-like action which allows it to be secured in the keyway.

As illustrated in FIG. 7, the base section 70 of the assembly is also punched into a cup-like configuration and the side wall of the cup crimped over to form the top wall 71 of the base. The metal sheet forming the base is precut prior to shaping the base so that a central opening 73 and a slotted keyway 74 are created in the base by crimping the side walls of the base inwardly. A recess 75 is stamped into the bottom wall of the base and is provided with four holes 76—76 which enable the base to be sewn to a garment.

To assemble the button the spring-like lugs on the button head key are depressed and the key is inserted into the keyway formed in the base. The head is moved laterally over the base until such time as the end face 77 (FIG. 6) of the key contacts the interior surface of the base side wall. When this occurs, the two button sections are in registration and the assembly is locked in place by the biasing action of the spring-like lugs.

While this invention has been described with reference to the structure disclosed herein, it is not confined to the details set forth and this application is intended to cover any modifications or changes as may come within the scope of the following claims.

I claim:

1. A two piece interchangeable button assembly that includes a base section having a flat top surface, a centrally located recess passing downwardly through the top surface of the base to a predetermined depth, a series of thread receiving holes passing upwardly through the bottom of the base into the recess whereby the base can be sewn to a garment, a T-shaped keyway disposed inwardly through the side wall of the base having a narrow vertical opening passing downwardly through the top surface of the base and an expanded horizontal slot that is parallelly aligned with said top surface, a button head having a flat bottom surface that complements the top surface of the base, a locking key depending downwardly from the bottom surface of said button head that is slidably received within the keyway formed in the base, said locking key having a stem that fits snuggly into the vertical opening of the keyway and an expanded lug that fits snuggly into the horizontal slot of the keyway such that moving the locking key laterally into the keyway brings the top surface of the base into tight sliding relationship with the bottom surface of the button head, and a stop means associated with the base to intercept the locking key when the top surface of the base is in overlying registration with the top surface of the button head and thus preventing further entry of the locking key into the keyway.

2. The button assembly of claim 1 wherein the key and the base section are both formed of a resilient material.

3. The button assembly of claim 1 that further includes a detent means acting between the top surface of the base section and the bottom surfaces of the button head for locking the base to the head in a registered position.

4. The button assembly of claim 1 wherein the depth of the recess is greater than the depth of the keyway and the keyway passes through said recess.

5. The button assembly of claim 1 wherein said base is generally convex in form and further includes a dome shaped enclosure which surrounds the recess.

* * * * *